US007040619B2

(12) United States Patent
Hosaka

(10) Patent No.: US 7,040,619 B2
(45) Date of Patent: May 9, 2006

(54) GAME MACHINE

(75) Inventor: Toshiyuki Hosaka, Matsumot (JP)

(73) Assignee: Seiko Epson Corporation, (JP)

( * ) Notice: Subject to any disclaimer, the term of this patent is extended or adjusted under 35 U.S.C. 154(b) by 10 days.

(21) Appl. No.: 10/840,798

(22) Filed: May 6, 2004

(65) Prior Publication Data

US 2005/0035542 A1 Feb. 17, 2005

(30) Foreign Application Priority Data

May 6, 2003 (JP) ..... 2003-128085

(51) Int. Cl.
*A63F 7/02* (2006.01)

(52) U.S. Cl. ..... 273/121 B

(58) Field of Classification Search ..... 273/108, 273/118 R, 118 A, 119 R, 119 A, 121 R, 273/121 A, 123 R, 123 A
See application file for complete search history.

(56) References Cited

U.S. PATENT DOCUMENTS 4,406,457 A * 9/1983 Gabrius et al. ..... 273/121 A
5,316,303 A * 5/1994 Trudeau et al. ..... 273/121 A
5,725,210 A * 3/1998 Yamaguchi et al. .... 273/121 B
6,854,729 B1 * 2/2005 Yamaguchi ..... 273/121 B

FOREIGN PATENT DOCUMENTS

JP 0312877 A * 5/1991
JP 05084347 A * 4/1993
JP P2001-293156 A * 10/2001
JP P2001-314568 A * 11/2001
JP 2002-200231 7/2002

* cited by examiner

*Primary Examiner*—Raleigh W. Chiu
(74) *Attorney, Agent, or Firm*—Harness, Dickey & Pierce, P.L.C.

(57) ABSTRACT

A game machine comprises a display section that displays a gaming image thereon, and a game board that is formed to be capable of having gaming parts fixed thereto, and is disposed on a front side of the display section, such that game balls are movable on a front side thereof, wherein the game board has game ball passages formed through an inside thereof such that the game balls can pass through the game ball passages, and at the same time a part of the game board opposed to a part of the display section where the gaming images are displayed are formed of a light-pervious material.

4 Claims, 5 Drawing Sheets

GAME MACHINE

BACKGROUND OF THE INVENTION

1. Field of the Invention

The present invention relates to a game machine comprising a display section for displaying gaming images, and a game board disposed on a front side of the display section.

2. Description of the Related Art

Today, many of pachinko machines (game machines; a Japanese bagatelle-type playing machine that is one example of a "game machine" of the present invention) have a monitor disposed on a game board thereof, and are configured to be capable of staging scenes that amuse players by displaying various gaming images associated with gaming statuses on the monitor. However, it is generally difficult to arrange gaming parts, such as pins and accessories, on the monitor, and hence this kind of pachinko machine suffers from the problem of being restricted in the layout of gaming parts due to the presence of the monitor. In this case, it is possible to contemplate a method of disposing the monitor at an end portion of the game board, to thereby reduce the restriction in the layout of the gaming parts. However, this method makes it difficult to fully exhibit the effects of staging by the display of gaming images.

As a pachinko machine capable of solving the above problem, Japanese Laid-Open Patent Publication (Kokai) No. 2002-200231 discloses a pachinko machine (pachinko game machine) in which a light-pervious (transparent) resin-made game board (play board) having gaming parts, such as pins, fixed thereon, is disposed on the front side of a monitor section. In this pachinko machine, the monitor section and the game board are formed as separate bodies, which makes it possible to dispose gaming parts at respective desired locations. Further, gaming images displayed on the monitor section are caused to be viewed through the game board, which makes it possible to employ a large-sized monitor section that is approximately the same size as the game board. Further, this pachinko machine (pachinko game machine disclosed as the second embodiment in the above publication) is configured such that game balls having entered prize openings formed in the game board fall through gaps between the rear surface of the game board and the front surface of the monitor section and are collected at the lowest part of the game board. In this case, in this pachinko machine, a light-pervious monitor section-protecting plate is disposed between the game board and the monitor section, which prevents game balls having entered prize openings from hitting against the monitor section and breaking the same.

However, through the study of the pachinko machine described above, the present inventor found out the following problems. In this pachinko machine, the monitor section-protecting plate is disposed between the game board and the monitor section, so as to prevent breakage of the monitor from strikes from the game balls having entered prize openings. This causes the attenuation of light due to the presence of the monitor section-protecting plate, making the gaming images obscure. Further, due to the disposition of the monitor section-protecting plate, the configuration of the rear side of the game board becomes complicated.

SUMMARY OF THE INVENTION

The present invention has been made to solve the problems described above, and an object thereof is to provide a game machine that is capable of clearly displaying gaming images and allows easy configuration of the rear side of a game board.

A game machine according to the present invention is a game machine comprising a display section that displays a gaming image thereon, and a game board that is formed to be capable of having gaming parts fixed thereto and is disposed on a front side of the display section, such that game balls are movable on a front side thereof, wherein the game board has game ball passages formed through an inside thereof such that the game balls can pass through the game ball passages, and at the same time a part of the game board opposed to a part of the display section where the gaming image is displayed is formed of a light-pervious material.

In this game machine, the game ball passages through which game balls can pass are formed though the inside of the game board. This makes it possible to cause, for example, game balls having entered prize holes to pass through the game ball passages to be collected via the lowest part of the game board, without causing them to pass between the game board and the display section. Therefore, differently from the conventional game machines which cause game balls to pass between the game board and the display section, a protection plate for preventing breakage of the front side of the display section can be dispensed with, which makes it possible to view the gaming image with correspondingly increased clarity. Further, since the protection plate can be dispensed with, the rear side of the game board can be easily configured in a simplified manner.

In this case, it is preferred that the game board is formed by bonding together a plurality of plate-like members formed with cuts, grooves, or holes, or at least two of them, which form the game ball passages. This configuration of the game board enables each plate-like member to be formed reliably and easily by injection molding or the like, even if the shapes of game ball passages are complicated.

Further, a game board according to the present invention is a game machine comprising a display section that displays a gaming image thereon, and a game board that is formed to be capable of having gaming parts fixed thereto, and is disposed on a front side of the display section, such that game balls are movable on a front side thereof, wherein the game board has game ball passages formed on a front side thereof such that the game balls can pass through the game ball passages, and at the same time a part of the game board opposed to a part of the display section where the gaming image is displayed is formed of a light-pervious material.

In this game machine, the game ball passages through which game balls can pass are formed on the front side of the game board. This makes it possible, similarly to the game machine having the game ball passages formed through the inside of the game board, to dispense with a protection plate for preventing breakage of the front side of the display section, which makes it possible to clearly view the gaming image. Further, since the protection plate can be dispensed with, the rear side of the game board can be easily configured in a simplified manner. Moreover, since the cuts and the like for forming the game ball passages need not be formed in advance, it is possible to form the game board inexpensively.

BRIEF DESCRIPTION OF THE DRAWINGS

These and other objects and features of the present invention will be explained in more detail below with reference to the attached drawings, wherein.

DESCRIPTION OF THE PREFERRED EMBODIMENTS

Hereinafter, preferred embodiments of the game machine according to the present invention will be described with reference to the accompanying drawings.

Figure 1:
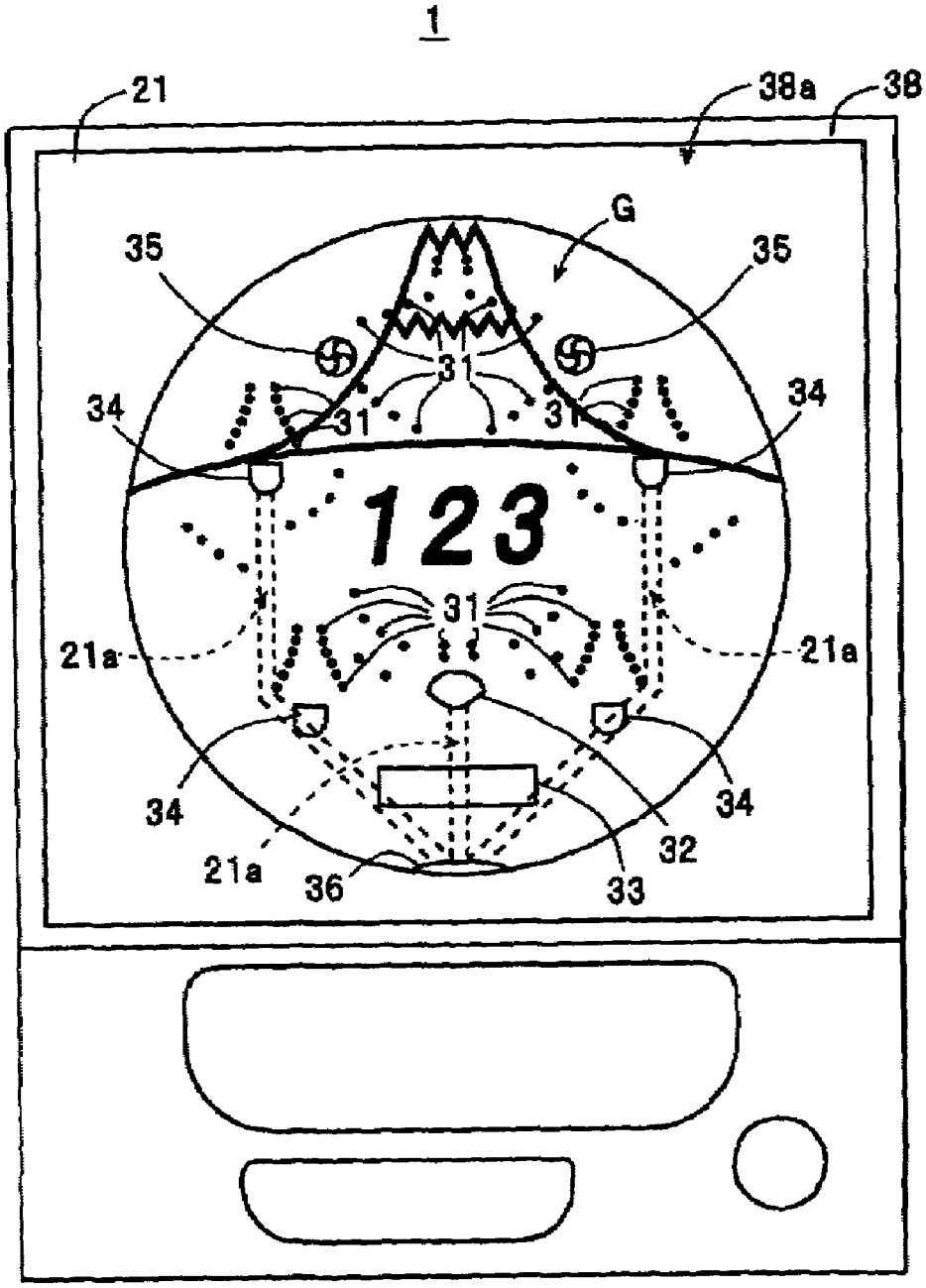
FIG. 1 is a front view schematically showing the construction of a pachinko machine.
Figure 2:
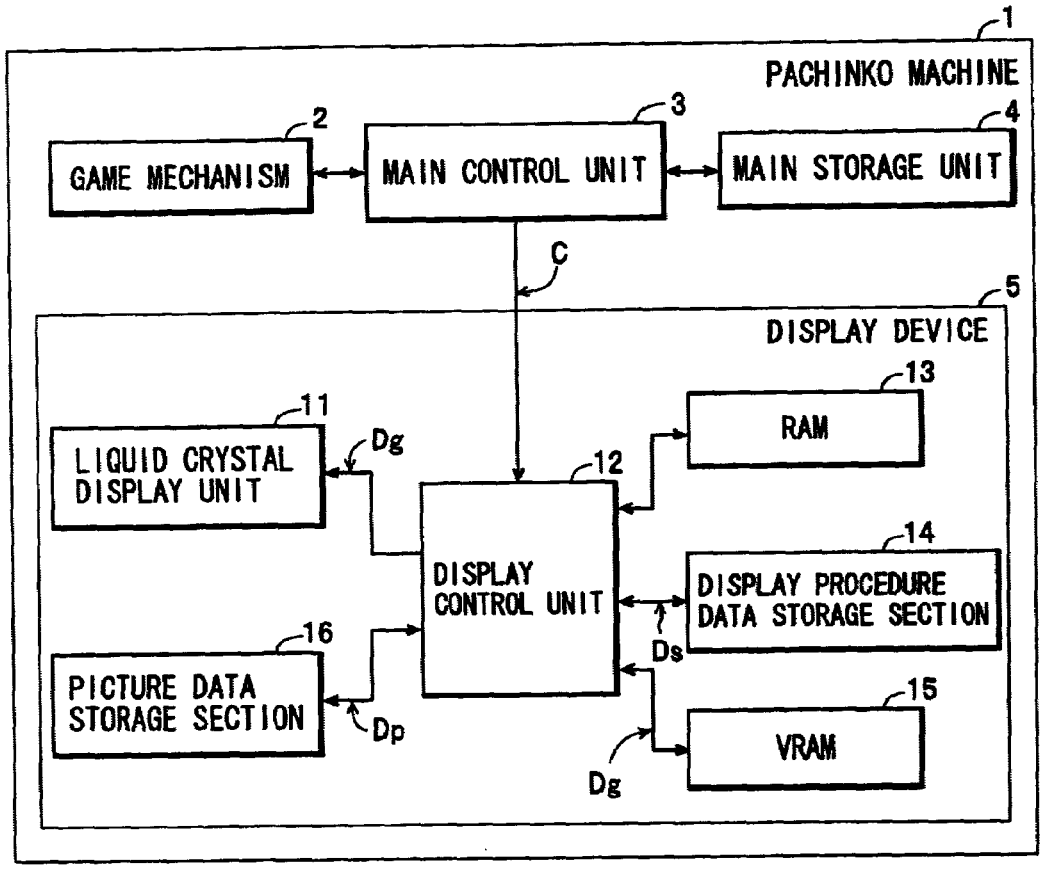
FIG. 2 is a block diagram showing the construction of the pachinko machine.

First, the construction of a pachinko machine (game machine) 1 will be described with reference to the drawings. As shown in FIG. 1, the pachinko machine 1 is a "Lucky Seven"-type pachinko machine, for example, in which a jackpot can occur by lot (chance), and is constructed such that it is capable displaying a gaming image G (for example, land, Mt. Fuji, and the numbers "123" shown in FIG. 1) on a liquid crystal display unit 11 (see FIG. 3). More specifically, as shown in FIG. 2, the pachinko machine 1 is comprised of a game mechanism 2, a main control unit 3, a main storage unit 4, and a display device 5.

Figure 3:
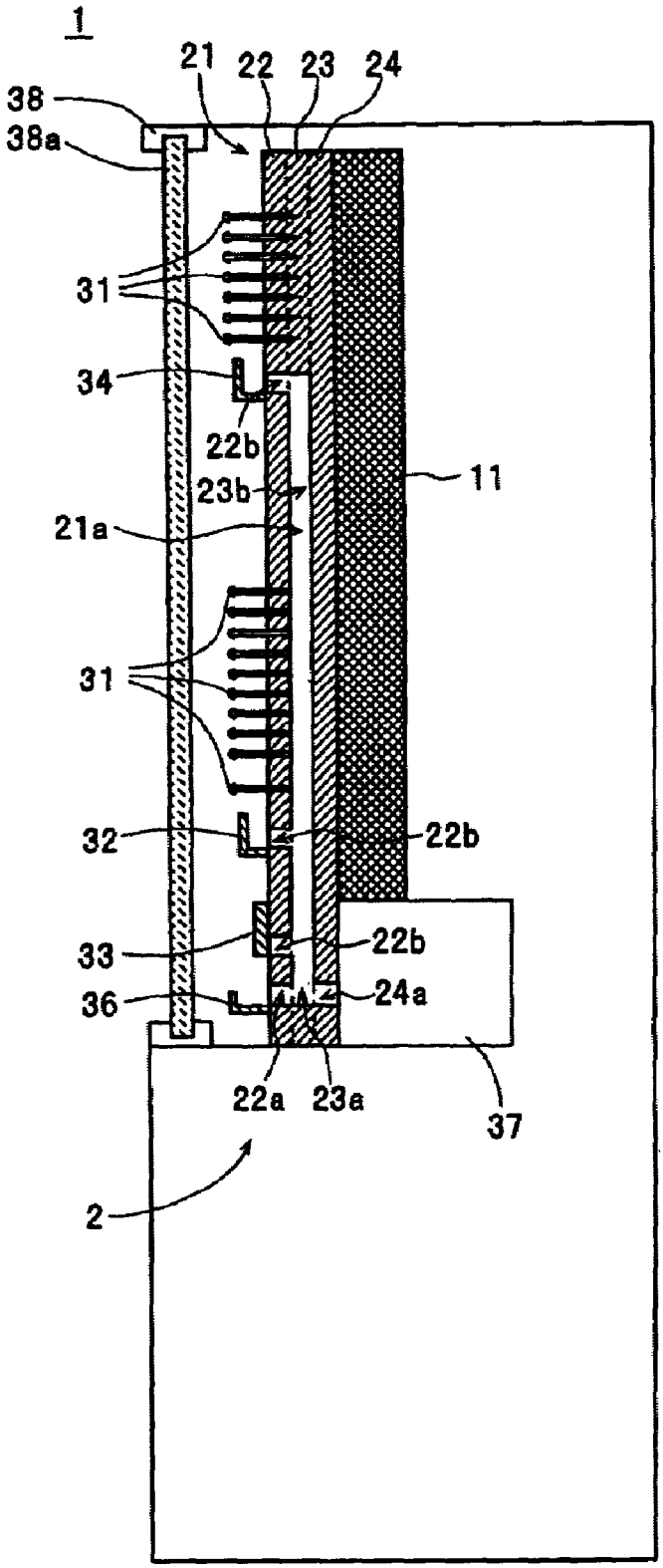
FIG. 3 is a side cross-sectional view schematically showing the construction of the pachinko machine.
Figure 4:
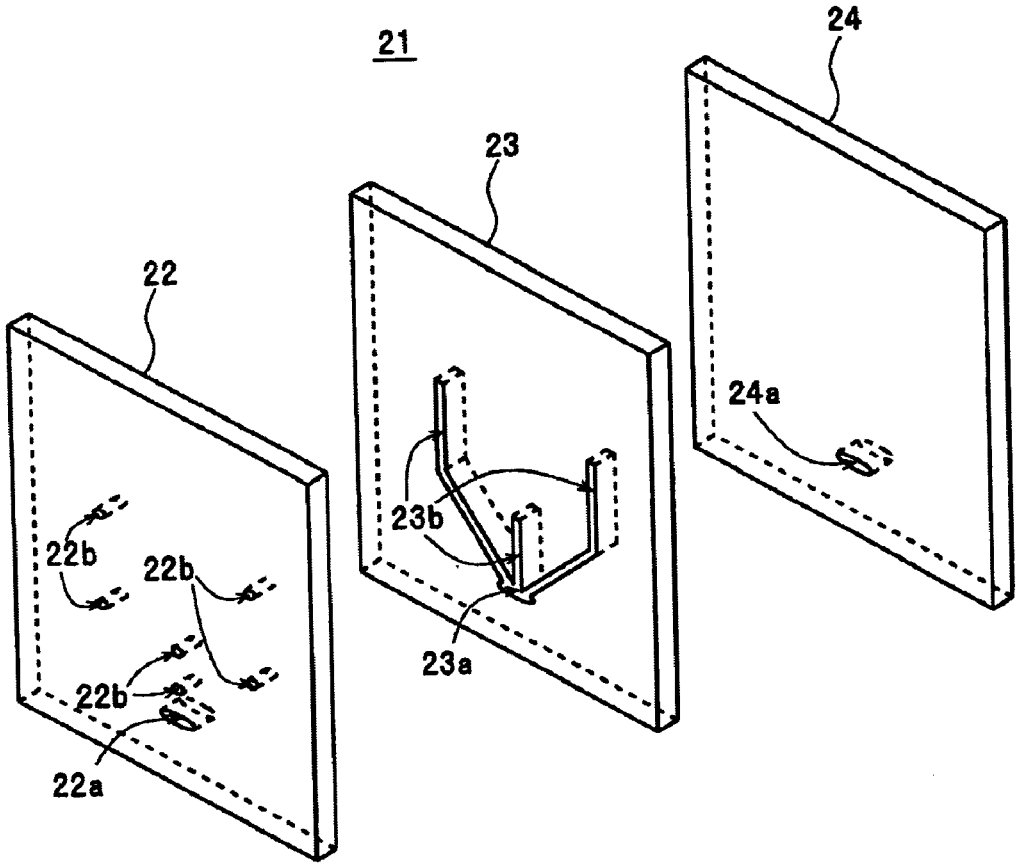
FIG. 4 is a perspective view showing the construction of a game board.

As shown in FIG. 3, the game mechanism 2 includes a game board 21 and a drive mechanism 37. As shown in FIGS. 1 and 3, the game board 21 has gaming parts, such as a plurality of pins 31, 31, . . . , a start chucker 32, a large prize opening ("attacker") 33, prize openings 34, 34, . . . , windmills 35, 35, and a collection opening 36, disposed thereon (fixed thereto). Further, the game board 21 is formed with passages (game ball passages) 21*a*, 21*a*, . . . , extending through the inside thereof for causing game balls having entered the large prize opening 33 and the prize openings 34, 34, . . . and game balls not having entered these openings but having entered the collection opening 36, to move to the drive mechanism 37. Further, as shown in FIG. 4, a part of the game board 21 opposed to part of the liquid crystal display unit 11 where the gaming image G is displayed is made of a light-pervious resin material (polycarbonate, for example). More specifically, the game board 21 is configured to have approximately the same size as that of the liquid crystal display unit 11, and therefore, the entire area (whole) thereof is in the form of a one-piece integral unit formed by bonding together the three plate-like members of a surface plate 22, an intermediate plate 23, and a rear plate 24, which are light pervious and have a rectangular shape in a front view. In this case, the surface plate 22, the intermediate plate 23, and the rear plate 24 are formed with cuts, grooves, or holes, or ones of at least two of these, and formed by, for example, injection molding and bonding them together using light-pervious adhesives.

The surface plate 22 is, as shown in FIGS. 3 and 4, formed with a hole 22*a* at a location corresponding to a location where the collection opening 36 is formed, and with holes 22*b*, 22*b*, . . . at respective locations of the start chucker 32, the large prize opening 33, and the prize openings 34, 34, . . . . Further, the intermediate plate 23 is formed with a hole 23*a*, which communicates with the hole 22*a* of the surface plate 22 in a state bonded to the intermediate plate 23, and with cuts 23*b*, 23*b*, . . . which communicate with the holes 22*b*, 22*b*, . . . of the surface plate 22 in the state bonded to the intermediate plate 23 and extend up to the rear side surface thereof toward the rear plate 24. Further, the rear plate 24 is formed with a hole 24*a* communicating with the hole 23*a* of the intermediate plate 23 in the state of the plates bonded together. In this case, the holes 22*a*, 22*b*, 23*a*, and 24*a*, and the cuts 23*b* form the passages 21*a*. It should be noted that as shown in FIG. 3, a door 38 with a light-pervious glass plate 38*a* fitted therein is mounted on the front of the game board 21. As shown in FIG. 3, the drive mechanism 37 is mounted to a rear surface of the game board 21, and pays out game balls and opens and closes the large prize opening 33 in accordance with instructions from the main control unit 3. Further, the drive mechanism 37 transfers (collects) game balls having passed through the passages 21*a* and moved to the drive mechanism 37 to a game ball-collecting section, not shown.

The main control unit 3 carries out control of the drive mechanism 37 and the display device 5 in a centralized manner, and also carries out random selection when a game ball has entered the start chucker 32. The main control unit 3 also outputs a command C when there is a change in the game play state, such as when the random selection starts or when the jackpot has occurred, and thereby causes the display device 5 to carry out an image display process for causing various types of gaming images G to be displayed. In this case, the main control unit 3 delivers the command C including designation of display procedure data Ds (this will be described later) required for displaying the gaming image G. The main storage unit 4 stores an operation program of the main control unit 3, and the like.

As shown in FIG. 2, the display device 5 includes the liquid crystal display unit 11, a display control unit 12, a RAM 13, a display procedure data storage section 14, a VRAM 15, and a picture data storage section 16. The liquid crystal display unit 11, which corresponds to a display section in the present invention, is formed such that it has the same size as the game board 21 and has a rectangular shape in front view, and disposed with its front surface close to (preferably in close contact with) the rear surface of the game board 21. Further, the liquid crystal display unit 11 is formed such that it includes a liquid crystal panel capable of displaying colors and a backlight, neither of which is shown, whereby various types of gaming images G based on display image data Dg outputted by the display control unit 12.

The display control unit 12 carries out the image display process in accordance with the command C outputted by the main control unit 3 to generate the display image data Dg for displaying various types of gaming images G and outputs the display image data Dg to the liquid crystal display unit 11. The RAM 13 temporarily stores various kinds of data generated by the display control unit 12. The display procedure data storage section 14 stores the display procedure data Ds, in which designations of pictures used in the gaming image G and a display position and size of the gaming image G are written. The VRAM 15 stores the display image data Dg generated when an image is virtually drawn by the display control unit 12. The picture data storage section 16 stores various picture data Dp (picture data for land, Mt. Fuji, numbers, and the like) for generating the display image data Dg.

Next, the overall operation of the pachinko machine 1 will be described with reference to the drawings. When the power is turned on, the main control unit 3 in the pachinko machine 1 first outputs a command C that designates display procedure data Ds for displaying the gaming image G for an initial state of the machine shown in FIG. 1, by way of example. In response to this, the display control unit 12 checks the content of the command C and executes the image display process. In this image display process, the display control unit 12 reads the display procedure data Ds designated by the command C from the display procedure data storage section 14. Next, in accordance with the procedure of the read display procedure data Ds, the display control unit 12 reads picture data Dp, Dp, . . . required for generating the display image data Dg for displaying the gaming image G, from the picture data storage section 16. Next, the display control unit 12 virtually draws pictures corresponding to the read picture data Dp, Dp, . . . on a virtual screen in the VRAM 15 (i.e., causes the VRAM 15 to store the pictures), thereby forming the display image data Dg in the VRAM 15.

After this, the display control unit 12 outputs the display image data Dg stored in the VRAM 15 to the liquid crystal display unit 11. Thereafter, the display control unit 12 repeatedly carries out the reading of picture data Dp, and generation and delivery of display image data Dg, until a new command C is issued. On the other hand, the liquid crystal display unit 11 displays the gaming image G based on the display image data Dg outputted by the display control section 12. As a consequence, as shown in FIG. 1, the gaming image G is displayed on the liquid crystal display unit 11 and viewed through the light-pervious game board 21. In this case, since the liquid crystal display unit 11 is disposed such that the front surface thereof is close to the rear surface of the game board 21, the gaming image G can be clearly viewed.

Next, after starting the game, when a game ball enters a prize opening 34, the main control unit 3 causes the drive mechanism 37 to pay out a predetermined number (e.g. seven) of game balls. On this occasion, the game ball having entered the prize opening 34 moves through a passage 21*a* (passes the same) to move to the drive mechanism 37, and is transferred (collected) by the drive mechanism 37 to the game ball-collecting section, not shown. Next, when a game ball has entered the start chucker 32, the main control unit 3 carries out random selection. On this occasion, the game ball having entered the start chucker 32 moves through a passage 21*a* to the drive mechanism 37, and is transferred to the game ball-collecting section. Then, if the entered ball is determined to be a prize-losing one by random selection, the main control unit 3 outputs a command C designating display procedure data Ds for displaying a gaming image G for prize-losing game balls. In response to this, the display control unit 12 checks the content of the command C and carries out the image display process described above, thereby outputting the display image data Dg. This causes the gaming image G for prize-losing game balls to be displayed on the liquid crystal display unit 11. In this case, the gaming image G for prize-losing game balls is formed of images in which three columns of numbers of 1 to 9 are scrolled over a predetermined time period, and then the speed of scroll gradually is decreased to eventually cause the three columns to stop at respective different numbers.

On the other hand, if a "jackpot" has occurred as a result of the random selection, the main control unit 3 outputs a command C designating display procedure data Ds for displaying a gaming image G for staging the jackpot, and the display control unit 12 checks the content of the command C and carries out the image display process to thereby output display image data Dg. This causes the gaming image G for staging the jackpot to be displayed on the liquid crystal display unit 11. In this case, the gaming image G for staging the jackpot is formed of images in which, for example, the three columns of numbers of 1 to 9 are scrolled over a predetermined time period and then stop at the same number (e.g. "7"), and the numbers (in this case, "7", "7", and "7") where the scroll is stopped are flashed, and an animated image of fireworks being displayed.

Next, the main control unit 3 causes the drive mechanism 37 to open and close the large prize opening 33 e.g. fifteen times. In doing this, when the game ball has entered the large prize opening 33, the main control unit 3 causes the drive mechanism 37 to pay out fifteen game balls. In this case, the game ball having entered the large prize opening 33 moves through a passage 21*a* to the drive mechanism 37, and is transferred to the game ball-collecting section. Then, when the opening and closing of the large prize opening 33 (fifteen-times in the present case) is terminated (when the jackpot is terminated), the main control unit 3 outputs a command C designating display procedure data Ds for causing an ending image that stages ending of the jackpot to be displayed. In response to this, the display control unit 12 carries out the image display process to output display image data Dg, whereby the ending image is displayed on the liquid crystal display unit 11. After this, whenever a game ball enters the start chucker 32, the above-described process is carried out. On the other hand, game balls which have dropped to the lower side of the game board 21 without entering any of the start chucker 32, the large prize opening 33, and the prize openings 34, move from the collection opening 36 through the holes 22*a*, 23*a*, and 24*a* to the drive mechanism 37, and are then transferred to the game ball-collecting section.

As described heretofore, according to this pachinko machine 1, the passages 21*a* for causing game balls to move are formed through the inside of the transparent game board 21, whereby the game balls having entered any of the start chucker 32, the large prize opening 33, and the prize openings 34 can be caused to move to the drive mechanism 37 without causing them to pass between the game board 21 and the liquid crystal display unit 11. Therefore, differently from the conventional pachinko machines, the protection plate for protecting the liquid crystal display unit 11 from breakage can be dispensed with, which makes it possible to avoid attenuation of light by the protection plate, whereby the gaming images can be viewed with correspondingly increased clarity. Further, since the protection plate can be dispensed with, the rear surface side of the game board can be easily configured in a simplified manner.

Further, the game board 21 is formed by bonding together the surface plate 22, the intermediate plate 23, and the rear plate 24, which are formed with the holes 22*a*, 22*b*, 23*a*, and 24*a*, and the cuts 23*b*, whereby even if the shapes of the passages 21*a* are complicated, the boards 22 to 24 can be formed reliably and easily by injection molding or the like.

Figure 5:
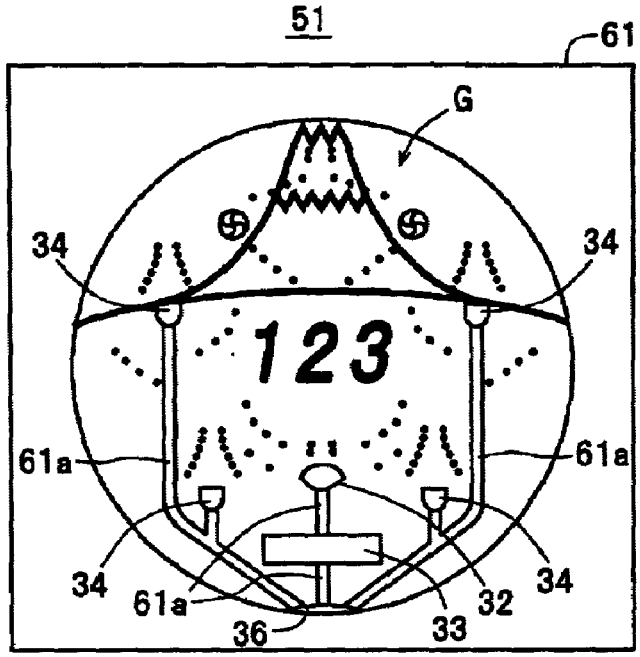
FIG. 5 is a front view schematically showing the construction of a game board of another pachinko machine.
Figure 6:
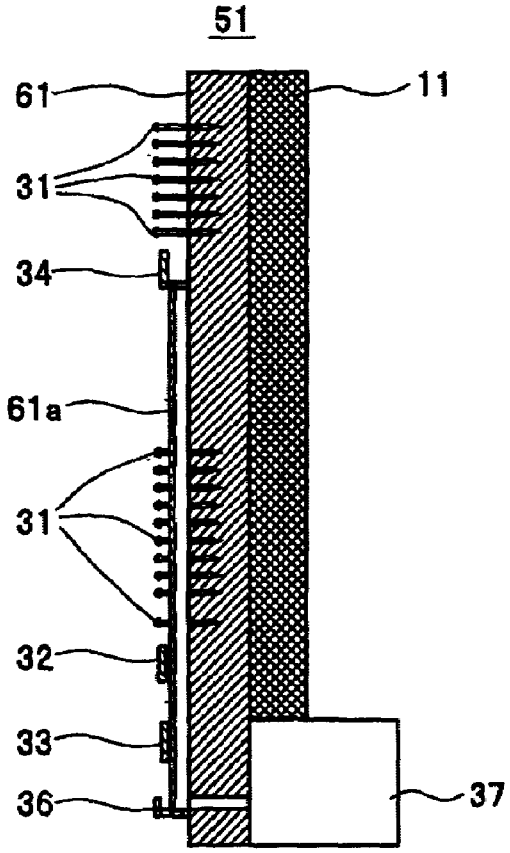
FIG. 6 is a side cross-sectional view schematically showing the construction of a game board of another pachinko machine.

It should be noted that the present invention is not limited to the embodiment described above. For example, although in the present embodiment, the description has been given of an example in which the passages 21*a* for causing game balls to move are formed through the inside of the game board 21, this is not limitative, but as shown in FIGS. 5 and 6, a pachinko machine 51 can be configured to include a game board 61 with passages 61*a*, 61*a*, . . . formed in (attached to) the front side thereof, through which game balls can pass, and which are light-pervious and formed to be U-shaped in cross-section and open on the game board 61 side, in place of the passages 21*a* except the portions corresponding to the holes 22*a*, 23*a*, and 24*a*. According to this pachinko machine 51, it is unnecessary to form the holes

22*b* or the cuts 23*b*, which constitute the passages 21*a*, in the game board 61 in advance, so that the game board 61 can be formed by a single plate-like member. As a result, it is possible to form the game board 61 inexpensively. It should be noted that the passages 61*a* are not necessarily required to be U-shaped in cross-section, but they may be formed to have a hollow cylindrical shape.

Also, in place of the liquid crystal display unit 11, a CRT or a plasma display may be employed. Further, the present invention may be applied to pachinko machines which are equipped with a screen panel and a projector device, in place of the liquid crystal unit 11, for displaying a gaming image on the screen panel by projection based on the rear projection method. Further, although in the embodiment of the present invention, the game board 21 formed by bonding together the three plate-like members of the surface plate 22, the intermediate plate 23, and the rear plate 24, has been described by way of example, the number of plate-like members forming the game board 21 is not limited to three. For example, by forming the cuts 23*b* in the intermediate plate 23 as grooves, the game board 21 can be formed by two plate-like members, i.e., the surface plate 22 and the intermediate plate 23. Further, it is possible to form the game board 21 using a desired number of plate-like members, such as four or more of the same.

Moreover although in the embodiment of the present invention, the game board 21 (surface plate 22, intermediate plate 23, and rear plate 24), all of which are formed of a light-pervious resin, has been described by way of example, all of the game board 21 is not necessarily required to be light-pervious, but it is possible to employ a game board with portions (e.g. portions opposed to portions where gaming images are not displayed) formed by a light-impervious material (e.g. wood). Further, the game board may be formed, after forming all of the game board using light-pervious resin, by attaching light-impervious thin-plate members or applying light-impervious paints, to portions of the surface thereof.

What is claimed is:

1. A game machine comprising:

a display section that displays a gaming image thereon; and a game board adapted to have gaming parts fixed thereto, the game board being disposed on a front side of the display section such that game balls are movable on a front side of the display section, wherein the game board has game ball passages formed through an inside thereof such that the game balls can pass through the game ball passages, and at the same time a part of the game board opposed to a part of the display section where the gaming image is displayed is formed of a light-pervious material;

wherein at least a part of the light pervious material is disposed between the game ball passages and the display section.

2. The game machine as claimed in claim 1, wherein the game board comprises a plurality of plate-like members bonded together and including at least two cuts, grooves, and holes formed therein to form the game ball passages.

3. A game machine comprising:

a display section that displays a gaming image thereon; and a game board adapted to have gaming parts fixed thereto, the game board being disposed on a front side of the display section such that game balls are movable on a front side of the display section, wherein the game board has game ball passages formed on a front side thereof such that the game balls can pass through the game ball passages, and at the same time a part of the game board opposed to a part of the display section where the gaming image is displayed is formed of a light-pervious material;

wherein at least a part of the light pervious material is disposed between the game ball passages and the display section.

4. A game machine comprising:

a display section selectively displaying a gaming image; and a game board disposed on a front side of the display section, the game board being adapted to have gaming parts fixed thereto and allow game balls to move on a front side of the display section;

wherein the game board includes a plurality of plate-like members bonded together and including at least two of cuts, grooves, and holes therein forming game ball passages in an interior of the game board allowing game balls to pass through the game ball passages; and a part of the game board opposed to a part of the display section where the gaming image is displayed is transparent;

wherein at least a part of the transparent part of the game board is disposed between the game ball passages and the display section.

* * * * *